United States Patent [19]

Johdai et al.

[11] Patent Number: 4,638,992

[45] Date of Patent: Jan. 27, 1987

[54] SORTING APPARATUS

[75] Inventors: Akiyoshi Johdai; Hirokazu Yamada; Yoshikazu Ikenoue; Takuma Ishikawa, all of Toyokawa, Japan

[73] Assignee: Minolta Camera Kabushiki Kaisha, Osaka, Japan

[21] Appl. No.: 792,733

[22] Filed: Oct. 28, 1985

[30] Foreign Application Priority Data

Nov. 7, 1984 [JP] Japan ..... 59-235606

[51] Int. Cl.[4] ..... B65H 39/11

[52] U.S. Cl. ..... 271/293; 271/294; 271/296

[58] Field of Search ..... 271/292, 293, 294, 296

[56] References Cited

U.S. PATENT DOCUMENTS

| | | | |
|---|---|---|---|
| 4,337,936 | 7/1982 | Lawrence | 271/293 |
| 4,343,463 | 8/1982 | Lawrence | 271/293 |
| 4,478,406 | 10/1984 | DuBois | 271/293 |

*Primary Examiner*—Richard A. Schacher

*Attorney, Agent, or Firm*—Wenderoth, Lind & Ponack

[57] ABSTRACT

A sorting apparatus of a spiral cam type for sorting or collating copy paper sheets discharged from a copying machine and the like, having a spiral groove of each spiral cam formed in an amount equivalent to the sum of the distance between bins in an expanded condition for receiving copy paper sheet and the distance between the bins in a non-expanded condition to eliminate vertical movements of the bins not directly related to the sorting or collating during expansion of the space between the bins.

9 Claims, 15 Drawing Figures

PRIOR ART
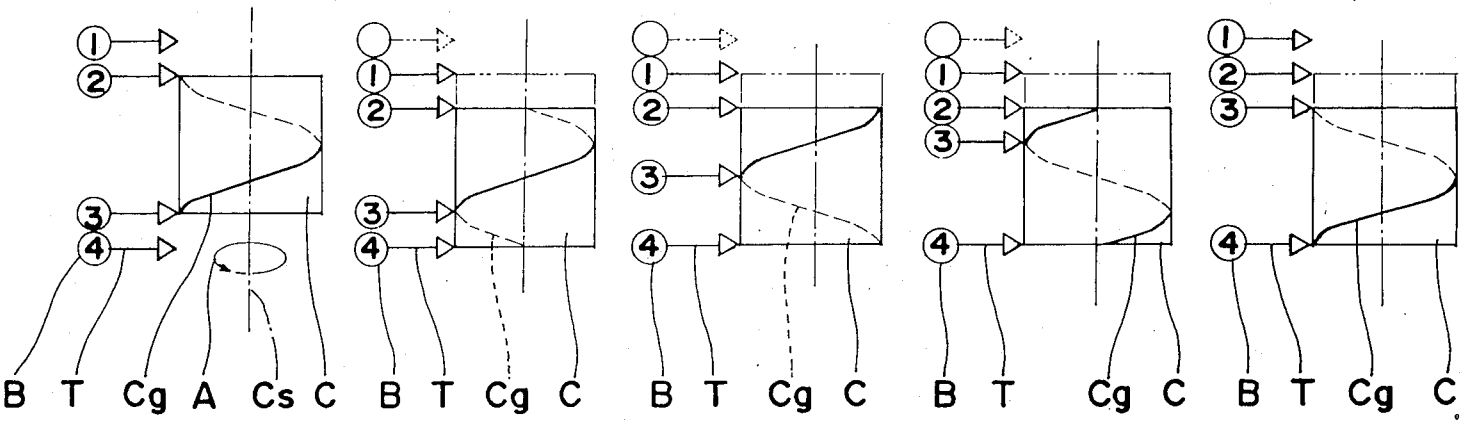

1
2
3
4
27
28
35
A
42
31

SORTING APPARATUS

BACKGROUND OF THE INVENTION

The present invention generally relates to a sorter and more particularly, to a sorting apparatus of a "floating" spiral cam type to be used in copying arrangements such as a copying machine, printer, reader printer or the like for sorting or collating copy paper sheets discharged therefrom.

It is to be noted here that the terms "sorting" or "collating" used throughout the present specification and claims are intended to mean that "sorting" is a mode in which, in the case where, for example, three original documents are each copied for ten sheets, the copied sheets taken from the three original documents are distributed into respective bins, one sheet by one sheet, while "collating" is a mode in which copied sheets taken from one original document are all distributed into one bin.

It should be noted that the term "sorting apparatus of a floating spiral cam type" means a sorting apparatus in which each of the spiral cams having a spiral groove is arranged to be vertically movable along a rotary shaft, while it is rotated together with said rotary shaft upon rotation of the latter as in an example to be explained hereinafter.

The sorting apparatus of the above described type has conventionally been disclosed, for example, in U.S. Pat. No. 4,478,406 entitled "Apparatus For Sorting Photocopies". As shown in FIGS. 1 and 2, the known sorting apparatus S of a floating spiral cam type is releasably coupled to a copying machine (not shown) so as to receive copy paper sheets discharged through a pair of discharge rollers (not shown) provided at a discharge portion of the copying machine via guide plates g, and includes a pair of feed-in rollers $R_1$ and $R_2$ disposed in fixed positions, another pair of discharge rollers $R_3$ and $R_4$ arranged to be movable in unison with spiral cams C arc guided through slots $L_1$ formed in the frame of the apparatus S, an upper transport belt $V_1$ movably passed around the rollers $R_1$ and $R_3$, a lower transport belt $V_2$ also movably passed around the rollers $R_2$ and $R_4$, a plurality of trays or bins B provided vertically at proper intervals for receiving copy paper sheets therein as specifically disclosed in said U.S. Pat. No. 4,478,046. Each of the bins B properly spaced from each other has a pair of trunnions T provided on a lip portion P of said bin to extend laterally from each side thereof, and said trunnions T are slidably received in a pair or slots $L_2$ formed in the frame of the sorting apparatus S for vertical movements so that the interval between the bins B at the side of the discharge rollers $R_3$ and $R_4$ may be enlarged to correspond to the positions of said rollers $R_3$ and $R_4$.

As shown in FIG. 2, a pair of rotary shafts Cs to be driven by a drive mechanism M are provided at the outer side of the frame of the sorting apparatus, and on each of said shafts Cs, the spiral cam C is fitted so as to be slidable along the shaft Cs in the vertical direction, but rotatable as one unit together with said shaft. (The sorting apparatus having the spiral cam moving in the above described manner is sometimes referred to as the sorting apparatus of a "floating" spiral cam type.) Each of the sprial cams C is formed, on its outer peripheral face, with a spiral groove Cg of a generally U-shaped cross section for 360° in the rotational angle, i.e., by one revolution so as to slidably receive the trunnion T therein. Accordingly, when the spiral cams C are rotated by one revolution, the trunnions T engage the spiral cams C by one set for displacement by one pitch.

Referring also to FIGS. 3(*a*) through 3(*e*), changes of the state with time of the bins B down to the fourth stage from the top, and the spiral cams C will be described hereinafter.

It is to be noted that in the following description, explanation will be given with reference to the spiral cam C and trunnion T only at one side for brevity, and that for differentiation of the bins B, trunnions T, etc. at respective stages, numerals 0, 1, 2, 3, 4 are affixed thereto in the numerical order from the top to the bottom. In FIGS. 3(*a*) through 3(*e*), the deviation in the vertical direction between the respective portions in the figures shows displacement in the relative level with respect to the frame of the sorting apparatus S.

In the first place, FIG. 3(*a*) shows the state where the sorting of copy paper sheets into the bin B-(3) is completed, and the rotary shaft Cs is to be driven for rotation in the direction of an arrow A so as to effect the sorting for the bin B-(4). Meanwhile, the sprial cam C is prevented from descending by the trunnion T-(3), with the bin B-(2) raised by one pitch of the spiral groove Cg, and the rotational angle at this time is assumed to be at 0°. FIG. 3(*b*) shows the state where the spiral cam C has been rotated by $\frac{1}{4}$ turn, and the spiral groove Cg leads the bin B-(3) upwardly, while the trunnion T-(3) receives the weight of the bin B-(3) and the bins B-(1) and B-(2) located thereabove descend with the spiral cam C until it reaches the trunnion T-4. FIG. 3(*c*) represents the state where the sprial cam C has been rotated by $\frac{1}{2}$ turn, and the spiral cam C rotates and is prevented from descending by the trunnion T-(4), thereby raising only the bin B-(3). FIG. 3(*d*) shows the state where the spiral cam C has effected a $\frac{3}{4}$ rotation, with the bin B-(3) raised to contact the bin B-(2). FIG. 3(*e*) denotes the state where the spiral cam C has rotated one revolution, in which the spiral cam C rotates from the state in FIG. 3(*d*) to raise the bin B-(3) along with the bins B-(1) and B-(2) located thereabove until the trunnion T-(3) is ultimately disengaged from the spiral groove Cg so as to return to the state before one rotation (rotational angle at 0°). Thus, the sorting for the bin B-(4) is effected in this state, and the similar functioning as described so far is intermittently effected at each sorting.

As described so far, in the known sorting apparatus S, the bins B (i.e., bins B-(1) and B-(2) in the above example) located at the upper stages above the bin B immediately after completion of the sorting, effect unnecessary vertical movement during rotation of the spiral cams C in spite of the fact that their positions are not altered before and after said rotation. Therefore, not only load torque of the spiral cam C is increased, but problems such as improper alignment of copy paper sheets on the bin B due to vibrations, etc. are invited, and such tendency becomes particularly conspicuous when high speed copying is to be effected.

SUMMARY OF THE INVENTION

Accordingly, an essential object of the present invention is to provide an improved sorting apparatus of a spiral cam type which makes it possible to eliminate vertical movements of bins not directly related to the sorting during expansion of the space or interval between the bins, in order to remove disadvantages inherent in the conventional arrangements of this kind.

Another important object of the present invention is to provide a sorting apparatus of the above described type which is simple in construction and stable in functioning, and can be readily manufactured at low cost.

In accomplishing these and other objects, according to one preferred embodiment of the present invention, there is provided a sorting apparatus of a spiral cam type which is so arranged that, with a pair of spiral cams being provided at opposite sides of the apparatus in a direction for feeding the copy paper sheets so as to be slidably mounted on rotary shafts for vertical movements thereon, but to be rotatable together with said rotary shafts only in the rotating direction, a plurality of bins are vertically provided in multi-stages at proper intervals for receiving copy paper sheets and arranged to be engageable with said spiral cams through suitable intermediate members, whereby each time copy paper sheets are discharged from the copying machine, the bins corresponding to the copy paper sheet accommodating position are successively engaged with the spiral cams and said rotary shafts are rotated for expanding intervals between the bins at said accommodating portion so as to sequentially sort the copy paper sheets into the bins at the respective stages. The sorting apparatus of the present invention as described above is characterized in that a spiral groove is formed on the outer peripheral surface of each of said spiral cams in an amount of a height equivalent to a sum of an interval or predetermined distance between said intermediate members during expansion of the interval between said bins, and a pitch or predetermined distance between the bins during non-expansion of said intervals.

By the arrangement according to the present invention as described above, an improved sorting apparatus has been presented through simple construction.

BRIEF DESCRIPTION OF THE DRAWINGS

These and other objects and features of the present invention will become apparent from the following description taken in conjunction with the preferred embodiment thereof with reference to the accompanying drawings, in which:

FIGS. 3(*a*) through 3(*e*) are diagrams for explaining changes of state with time for spiral cams and bins in the sorting apparatus of FIG. 1 (already referred to);

DETAILED DESCRIPTION OF THE INVENTION

Figure 2:
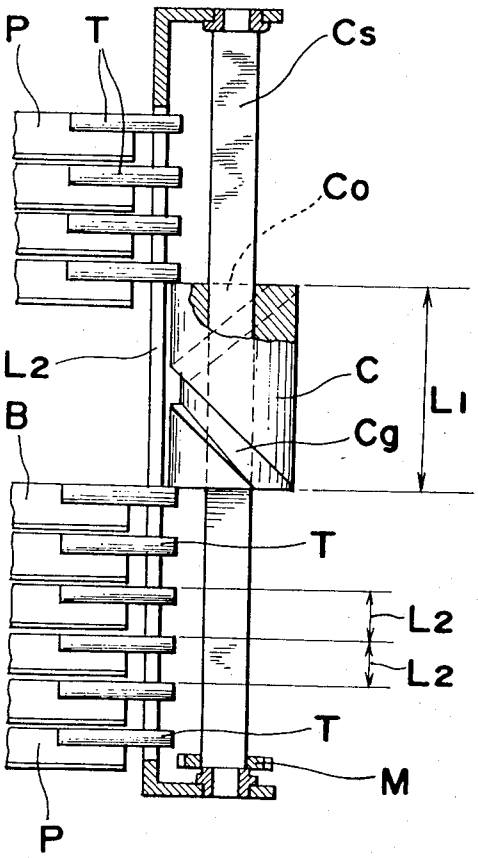
Fig. 2 PRIOR ART
FIG. 2 is an end elevational view partly in section of the sorting apparatus of FIG. 1 (already referred to)
Figure 1:
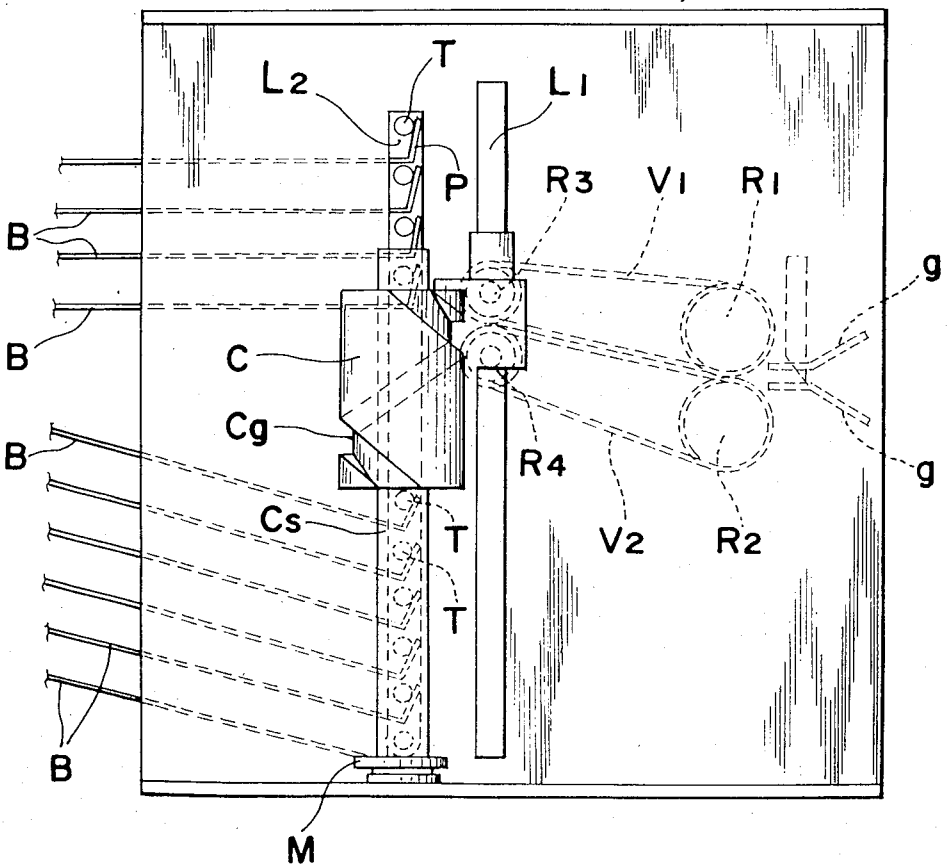
Fig. 1 PRIOR ART
FIG. 1 is a side elevational view showing internal construction of a conventional sorting apparatus (already referred to)

Before the description of the present invention proceeds, it is to be noted that like parts are designated by like reference numerals throughout the accompanying drawings.

Referring now to the drawings, an improved sorting apparatus of a spiral cam type according to the present invention will be described hereinbelow.

Figure 4:
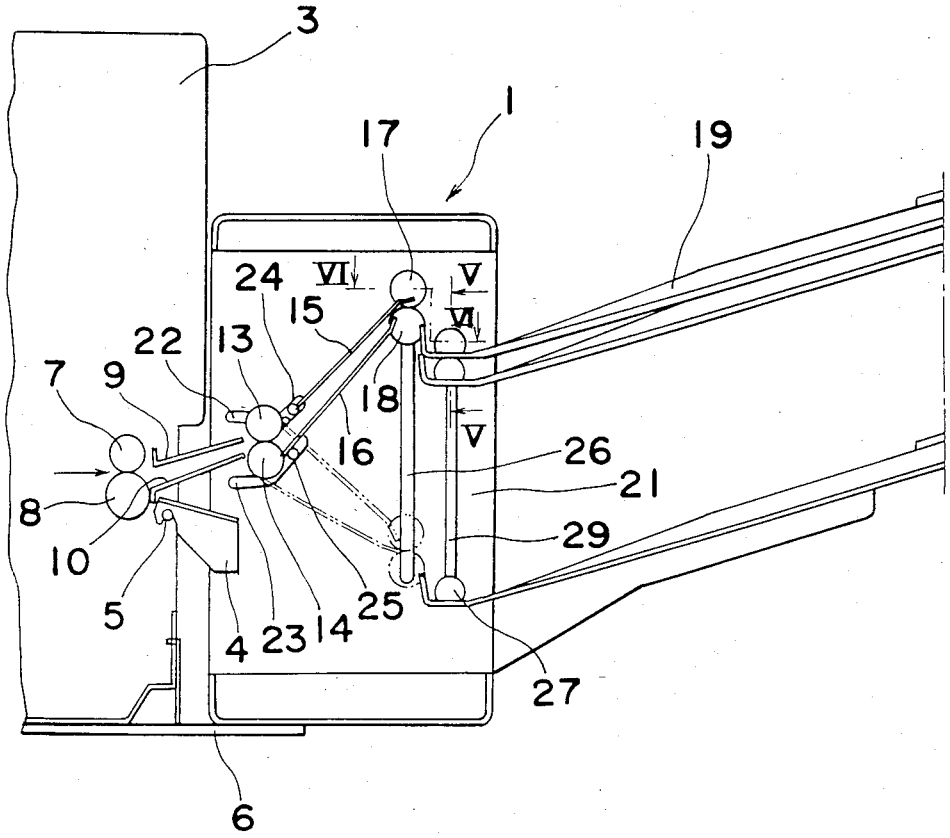
FIG. 4 is a side sectional view of a sorting apparatus according to one preferred embodiment of the present invention.
Figure 5:
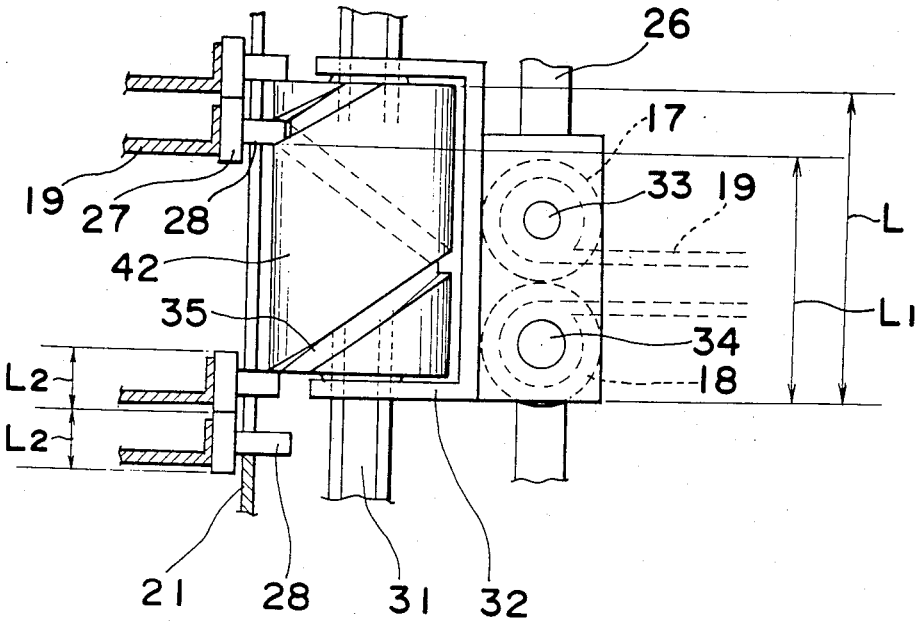
FIG. 5 is a side sectional view taken along the line V—V in FIG. 4.
Figure 6:
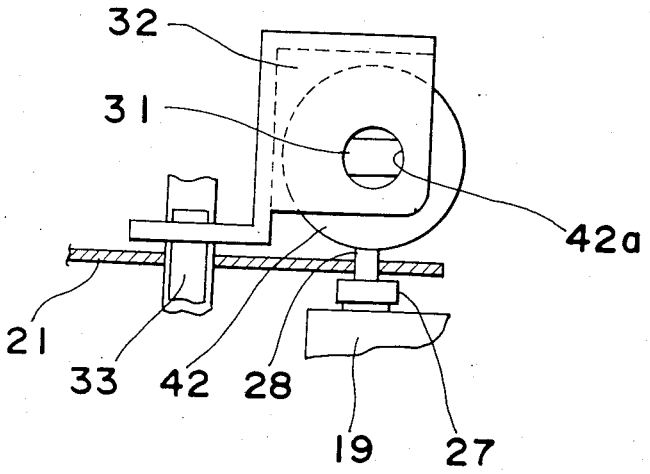
FIG. 6 is a cross sectional view taken along the line VI—VI in FIG. 4.

Referring to FIGS. 4 through 6, the sorting apparatus 1 according to the present invention is adapted to be releasably connected to a copying machine 3 by being supported on a support member 6 fixed to a bottom portion of the copying machine 3, with a hook 4 of the apparatus 1 being engaged with a pin 5 projecting from said copying machine, thereby to receive copy paper sheets discharged through a pair of discharge rollers 7 and 8 and guide plates 9 and 10 provided at a discharge portion of the copying machine 3, and generally includes a pair of feed-in rollers 13 and 14 facing the guide plates 9 and 10, another set of guide plates 15 and 16, discharge rollers 17 and 18, and the bins 19 for accommodating the copy paper sheets arranged vertically in multi-stages at proper intervals. More specifically, the feed-in rollers 13 and 14 are rotatably mounted on a frame 21 of the sorting apparatus 1, while the guide plates 15 and 16 are connected each at one end, to pins 24 and 25 slidably received in slots 22 and 23 of a generally V-shape formed in the frame 21, and at the other end thereof, associated with the discharge rollers 17 and 18 for vertical movement therewith, thereby both being inclined simultaneously so that the lateral positional deviation thereof is absorbed by the slots 22 and 23. Meanwhile, the discharge rollers 17 and 18 are rotatably provided so as to be also vertically movable upwardly or downwardly along first slots 26 formed in the frame 21, and adapted to be suitably raised or lowered each time the predetermined number of copy paper sheets are fed into the bin 19. Each of the bins 19 has a pair of bin spacers 27 attached to opposite sides on its one edge in the direction for feeding the copy paper sheets so as to space the respective bins 19 from each other at proper intervals, while a trunnion 28 as an intermediate or pin member is provided on each bin spacer 27 to project laterally outwardly therefrom. The trunnions 28 thus provided at opposite sides of the bin 19, one at each side thereof, are movably fitted in second slots 29 formed in the frame 21 for vertical movements therein, so that the interval between the bins 19 at the side of the discharge rollers 17 and 18 may be expanded to correspond to the positions of said discharge rollers 17 and 18.

At the other opposite side of the sorting apparatus 1 adjacent to the trunnions 28 of the bins 19, a pair of rotary shafts 31, each having a cross section of a rectangular shape rounded at its confronting short sides, are rotatably provided. Onto each of the rotary shafts 31, a cam case 32 and a spiral cam 42 are fitted so that they are slidable upwardly and downwardly along the rotary shaft 31, but only the spiral cam 42 is rotatable as one unit together with said shaft 31. More specifically, each of the spiral cams 42 is formed with an axial opening 42*a* (FIG. 6) having a cross section of the same rectangular shape rounded at its confronting short sides corresponding to the cross section of the rotary shaft 31, and since the rotary shaft 31 is inserted into said opening 42*a*, the spiral cam 42 is vertically slidable along the rotary shaft 31, but is rotated simultaneously with said rotary shaft upon rotation thereof. On the cam case 32, shafts 33 and 34 of the discharge rollers 17 and 18 are rotatably supported, and thus, said discharge rollers 17 and 18 may be raised or lowered together with the spiral cam 42.

Referring to FIG. 5, each of the spiral cams 42 has a spiral groove 35 of a generally U-shaped cross section formed on its outer peripheral surface. The spiral cam 42 has a height L equivalent to the sum of an interval $L_1$ between trunnions 28 of bins 19 upon expansion of said bins, and an interval $L_2$ between trunnions 28 of bins 19 upon non-expansion of said bins. The spiral groove 35 is formed in amount of the height L. Since one pitch of the spiral groove 35 corresponds to the height $L_1$, the groove 35 extends around outer peripheral surface of the cam 42 over an angle $(1+L_2/L_1)\times 360°$.

Subsequently, referring to FIGS. 7(*a*) through 7(*e*), changes of the state with time of the bin spacers 27 and spiral cams 42 from an upper to a lower fourth stage will be described as one example hereinafter.

In the description with reference to FIGS. 7(*a*) through 7(*e*) also, explanation will be made with respect to the spiral cam 42, bin spacer 27 and trunnion 28 only at one side in the similar manner as in FIGS. 3(*a*) through 3(*e*) described earlier, with numerals 1, 2, 3 and 4 being affixed thereto in the numerical order from the top to the bottom for differentiation.

Figures 7A, 7B, 7C, 7D, 7E:
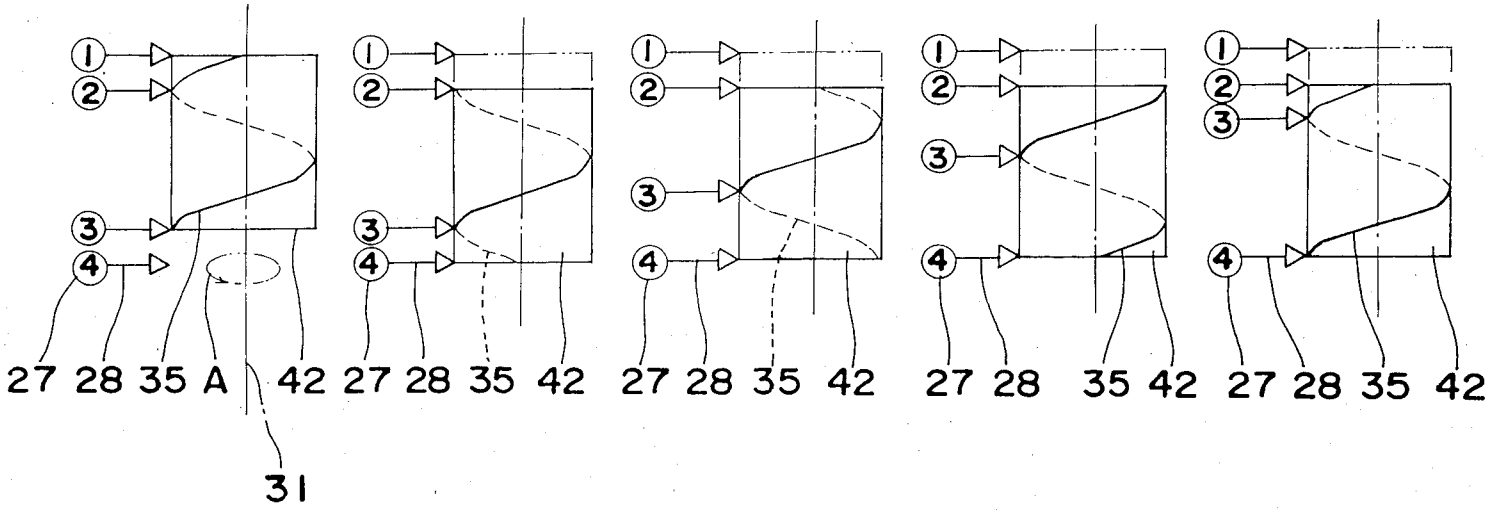
FIGS. 7(*a*) through 7(*e*) are diagrams showing changes of state with time for spiral cams and bin spacers in the sorting apparatus of FIG. 4.

It is to be noted that in FIGS. 7(*a*) through 7(*e*) also, the deviation in the vertical direction between the respective portions in the figures shows displacement in the relative level with respect to the frame 21 of the sorting apparatus 1, and that FIGS. 7(*a*), 7(*b*), 7(*c*), 7(*d*) and 7(*e*) respectively show the states where the spiral cams 42 are rotated by 0, $\frac{1}{4}$, $\frac{1}{2}$, $\frac{3}{4}$ and one rotation.

Firstly, FIG. 7(*a*) shows the state where the sorting of the copy paper sheets into the bin 19-(3) is completed, and the rotary shaft 31 is to be driven for rotation in the direction of an arrow A so as to effect the sorting for the bin 19-(4). Meanwhile, the spiral cam 42 is in the state restricted for descending by the trunnion 28-(3), and the rotational angle at this time is assumed to be at 0°.

In FIG. 7(*a*), although the states of the bin spacers 27-(1), 27-(2), 27-(3) and 27-(4) themselves (bin trunnions 28-(1) through 28-(4)) are exactly the same as in FIG. 3(*a*), the bin trunnion 28-(2) is engaged with the spiral groove 35 at an intermediate portion of the spiral cam 42, and more accurately, at a position lower than the upper surface of the spiral cam 42 by a height $L_2$ of the bin spacer 27.

In FIG. 7(*b*), in the similar manner as in FIG. 3(*b*), although the spiral cam 42 is lowered while rotating by the same distance as the height $L_2$ of the bin spacer 27, i.e., down to the position of the bin trunnion 28-(4), since the bin trunnion 28-(2) is located at the distance $L_2$ from the upper surface of the spiral cam 42, the bin trunnion 28-(2) is disengaged from the spiral groove 35 without any vertical movement, so as to be supported at the upper face of the spiral cam 42.

In FIG. 7(*c*), in the similar fashion as in FIG. 3(*c*), the bin spacers 27-(1), 27-(2) and 27-(4) are not vertically moved, and only the bin spacer 27-(3) is in the state of rising along the spiral groove 35.

In FIG. 7(*d*), although the bin spacer 27-(3) is in the same raised position as in FIG. 3(*d*), it is still spaced a certain distance from the bin spacer 27-(2), without contacting said bin spacer 27-(2), and only the bin spacer 27-(3) is in the raised state in the similar manner as before.

In FIG. 7(*e*), the bin spacer 27-(3) is raised by a predetermined distance for the expansion of the interval between the bins, and simultaneously, contacts the bin spacer 27-(2) at the upper stage, and the bin spacer 27-(3) is stopped together with the spiral cam 42.

More specifically, only the bin spacer 27-(3) directly related to the expansion of the interval between the bins for sorting is raised, while the bin spacers 27-(1) and 27-(2) located thereabove remain stationary in position without any vertical movement, and thus, as compared with the case of FIGS. 3(*a*) through 3(*e*), the load torque applied to the motor (not shown) for rotating the spiral cam 42 is reduced to a large extent.

As is clear from the foregoing description, according to the present invention, the spiral groove is formed on the outer periphery of the spiral cam, in an amount of a height equivalent to the sum of the interval or distance between the intermediate members during expansion of the interval between the bins and the pitch of or distance between the bins during non-expansion of said interval.

Therefore, it becomes possible to eliminate vertical movements of bins not directly related to the sorting during the expansion of the interval between the bins, and consequently, there are available such effects that not only the capacity of the motor for driving the sprial cam may be reduced, but non-alignment of copy paper sheets or noises due to vertical movements of bins irrelevant to the sorting can be advantageously eliminated.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sorting apparatus for sorting or collating copy paper sheets from a copying machine comprising:

a frame adapted to attach to a copying machine;

a plurality of bins supported on said frame for movement in a vertical direction, an adjacent pair of said bins being separated by a first predetermined distance in a non-expanded condition when copy paper sheets are not fed therebetween and being separated by a second predetermined distance in an expanded condition when copy paper sheets are fed therebetween, said second predetermined distance being greater than said first predetermined distance, each of said bins having a pair of pin members extending therefrom;

a pair of vertical shafts rotatably mounted on said frame;

a pair of cylindrical cams, each of which is mounted on a respective one of said vertical shafts, said cams being fixed for rotation with said vertical shafts and said cams being freely slidable in a vertical direction along said vertical shafts, each of said cams having a spiral groove formed on an outer cylindrical surface thereof for engagement with a respective one of said pair of pin members extending from a respective bin, each of said cams having a height in said vertical direction which is equal to at least the sum of said first and second predetermined distances, whereby a pair of adjacent bins are moved to an expanded condition without vertical movement of bins located above or below the bins being moved to an expanded condition.

2. The sorting apparatus of claim 1, wherein said spiral groove has a pitch equal to said second predetermined distance for one revolution of each of said cams.

3. The sorting apparatus of claim 1, wherein a pair of bin spacers are provided on each of said bins for separating each pair of adjacent bins in the non-expanded condition by said first predetermined distance.

4. The sorting apparatus of claim 3, wherein each of said pair of pin members extends from a respective one of said bin spacers.

5. The sorting apparatus of claim 1, further comprising a sheet transport means movably mounted on said frame for feeding copy paper sheets from a copying machine to a pair of adjacent bins in the expanded condition.

6. The sorting apparatus of claim 5, wherein said sheet transport means includes a pair of feed-in rollers rotatably mounted on said frame, a pair of movable guide plates movably mounted on said frame and a pair of discharge rollers movably mounted on said frame in a vertical direction, said guide plates movably mounted adjacent said pair of feed-in rollers and attached to said pair of discharge rollers.

7. The sorting apparatus of claim 6, further including a pair of cam cases, each of which is slidably mounted on a respective one of said pair of vertical shafts, each of said cam cases being connected to a respective one of said pair of cylindrical cams for movement therewith, said pair of discharge rollers being mounted between said pair of cam cases for movement therewith.

8. The sorting apparatus of claim 6, wherein each of said pair of guide plates is movably mounted in a guide slot of V-shape in said frame adjacent said pair of feed-in rollers.

9. The sorting apparatus of claim 1, wherein each of said pair of vertical shafts has a cross section of a rectangular shape rounded on the short sides of the rectangular shape and each of said pair of cylindrical cams has an axial opening therethrough which corresponds to the shape of a respective one of said vertical shafts.

* * * * *